US005816080A

United States Patent [19]

Jeziorowski

[11] Patent Number: 5,816,080

[45] Date of Patent: Oct. 6, 1998

[54] REFRIGERATOR SIDE-BY-SIDE DOOR SEAL ASSEMBLY

[75] Inventor: Les A. Jeziorowski, Coquitlam, Canada

[73] Assignee: Camco Inc., Mississauga, Canada

[21] Appl. No.: 879,612

[22] Filed: Jun. 20, 1997

[30] Foreign Application Priority Data

May 12, 1997 [CA] Canada ..... 2205157

[51] Int. Cl.[6] ..... E06B 7/16; F25D 11/02

[52] U.S. Cl. ..... 62/441; 49/478.1; 312/405

[58] Field of Search ..... 62/440, 441, 298; 49/475.1, 478.1, 480.1, 366; 312/116, 405

[56] References Cited

U.S. PATENT DOCUMENTS

| | | | |
|---|---|---|---|
| 2,565,891 | 8/1951 | Sherman | 292/1 |
| 2,723,896 | 11/1955 | Wurtz | 312/296 |
| 3,004,309 | 10/1961 | Korodi | 20/69 |
| 3,077,644 | 2/1963 | Kesling | 20/69 |
| 3,226,367 | 12/1965 | Monti | 20/69 |
| 3,248,159 | 4/1966 | Hall | 312/296 |
| 3,264,048 | 8/1966 | Koch et al. | 312/296 |
| 3,362,108 | 1/1968 | Jones | 49/478 |
| 3,382,618 | 5/1968 | Townsend | 49/483 |
| 3,408,772 | 11/1968 | Frehse | 49/366 |
| 3,461,610 | 8/1969 | Peters et al. | 49/478 |
| 3,487,581 | 1/1970 | Ellingson, Jr. | 49/478 |
| 3,726,578 | 4/1973 | Armstrong | 312/214 |
| 3,942,853 | 3/1976 | Grimm et al. | 312/296 |
| 4,226,489 | 10/1980 | Haag | 312/296 |
| 4,469,383 | 9/1984 | Losert | 312/296 |
| 4,644,698 | 2/1987 | Gerdes et al. | 49/478 |
| 4,653,819 | 3/1987 | Swerbinsky | 312/296 |
| 4,732,432 | 3/1988 | Keil et al. | 312/214 |
| 4,832,396 | 5/1989 | Moreno et al. | 296/164 |
| 4,916,864 | 4/1990 | Thompson | 49/478 |
| 5,129,184 | 7/1992 | Fish | 49/478 |
| 5,289,657 | 3/1994 | Kiel | 49/478.1 |
| 5,309,680 | 5/1994 | Kiel | 49/478.1 |
| 5,560,694 | 10/1996 | Banicevic et al. | 312/405 |

*Primary Examiner*—William Doerrler

[57] ABSTRACT

A gasket assembly for use in side-by-side, or French doors for a refrigerator has door stops which bear the door closure forces by engaging the top and bottom walls of the refrigerator food compartment. The door stops form part of an edge flange of a retainer that extends along the length of the refrigerator door. The retainer acts as a seat for a flexible gasket and maintains the integrity of the flexible gasket seal alignment between the side-by-side doors. The advantage provided is that a thermal seal barrier is maintained along the entire length of the door by the door stops maintaining the gasket a constant distance from the top and bottom walls of the food compartment.

4 Claims, 6 Drawing Sheets

REFRIGERATOR SIDE-BY-SIDE DOOR SEAL ASSEMBLY

TECHNICAL FIELD OF THE INVENTION

The present invention relates to a refrigerator door seal gasket assembly. In particular the invention is directed towards a refrigerator door gasket assembly for use between two side-by-side doors which are adapted to close and thermally seal a single open front access to the refrigerator.

BACKGROUND OF THE INVENTION

For several years the trend in domestic refrigerator cabinets has been to increase the size and in particular the width of the food compartments which brought about the use of double doors. The advantage of the larger refrigerator however, is lessened by fitting a freezer on one side and a refrigerator on the other side of a refrigerator cabinet with a space consuming center vertical mullion against which the side-by-side doors close. Omission of the vertical mullion to position the freezer compartment on the top with the fresh food compartment below and yet still have side-by-side doors across the freezer and fresh food compartments, introduces the problem of effectively sealing the doors along their juxtapositioned facing sides. Movable gaskets extend along the side face of each side-by-side door and contact each other to provide a thermal seal between the facing surfaces of the doors when the doors are closed. Each gasket includes magnets extending along the length of the door. The magnets in opposing gaskets are oppositely poled so that the magnetic poles attract when the doors are aligned in a side-by-side closed position. During door opening, when one door is moved relative to the other, like poles of the magnets pass by each other causing the magnets to repel and push the gaskets apart reducing wiping contact of the gaskets.

Many different magnetic gasket sealing assemblies for side-by-side or "French" doors used to close an open front of a refrigerator cabinet are disclosed in the U.S. patent literature. For example, U.S. Pat. No. 3,248,159 issued Apr. 26, 1996 to Charles Hall teaches the use of three sets of magnets in two gaskets. A first pair of magnets are arranged to attract and seal the two gaskets when the doors are in the closed position. This first pair of magnets are hingedly attached in a flexible gasket to a second pair of magnets, one in each gasket which pivot the gasket sealing faces to move the first pair of magnets out of contacting position relative to each other during opening and closing of the French doors to reduce wiping. The magnetic gasket seals are arranged forward of a recessed shoulder in each of the French doors.

U.S. Pat. No. 3,264,048 issued Aug. 2, 1996 to A. J. Koch et al describes a magnetic gasket seal for French doors where the gaskets overlap each other in the direction of opening which causes a wiping action which reduces the life of the gasket. Other examples of French door magnetic gasket seals are described in U.S. Pat. No. 3,408,772 issued to Frehse on Nov. 5, 1968; U.S. Pat. No. 3,726,578 issued Apr. 10, 1973 to William J. Armstrong; U.S. Pat. No. 4,226,489 issued Oct. 7, 1980 to Charles Haag; U.S. Pat. No. 4,288,135 issued Sep. 8, 1981 to Buchser et al; U.S. Pat. No. 5,289,657 issued Mar. 1, 1994 to Lowell Kiel and U.S. Pat. No. 5,309,680 issued May 10, 1994 to Lowell Kiel.

While the patent literature is concerned with sealing of French doors by using sealing gaskets with magnets that cause one or more of the door gaskets to move relative to the other gasket during opening/closing operation, these patents do not address the problems associated with heavily loaded hinge closing door forces which tend to "overdose" the juxtapositioned sides of the doors putting greater stress on the door sealing gaskets.

Because a French door gasket seal must extend along the entire length of the French doors to be effective, as the width of the refrigerator cabinet increases, the size and the weight of the double doors increases. This increases the stress placed on the hinges of these doors which can cause buckling and bowing of the doors. Further, the hinge closing force has a resultant force that pushes and loads the outer edge, or juxtapositioned facing surface, of the door to "over close" the door placing undue stress on the gasket seal where it contacts top and bottom walls of the refrigerator cabinet. With repeated opening and closing over the life of the refrigerator, the gasket may loose its shape adjacent the top and bottom walls causing gasket fatigue stress points and buckling of the gasket at this point. As a result the gaskets affixed to the opposing juxtapositioned sides of the refrigerator may become misaligned deteriorating seal integrity. While the use of a vertical mullion overcomes this problem because the entire length of the sealing gasket can close against the vertical mullion to distribute evenly the door closing forces along the length of the gasket and mullion, the use of the mullion defeats the purpose of providing a refrigerator cabinet having a single access to either or both of the fresh food compartment and the freezer food compartment positioned vertically above of below the fresh food compartment. Clearly, there is a need for a French door gasket seal that does not require a vertical mullion to compensate for door hinge closing forces associated with relatively large side-by-side doors.

SUMMARY OF THE INVENTION

The present invention relates to a novel sealing arrangement for use with French doors of a refrigerator which close a single access opening into a food compartment for the refrigerator. In particular, the present invention provides for a novel stopping feature located adjacent to the outer edge portion of each opposing juxtapositioned side of the French doors. The stopping feature projects forward of the French door towards the refrigerator compartment. The stops engage indirectly through a sealing gasket upper and lower front facing walls for the refrigerator cabinet and support the sealing gasket from closing forces that would otherwise unevenly load or overload the gasket seals. The stops maintain French door seals at constant distance from the top and bottom walls of the refrigerator cabinet which in turn maintains the integrity of the seal alignment of the gaskets along the length of the refrigerator doors when the doors are closed.

In accordance with one aspect of the present invention there is provided a refrigerator comprising a refrigerator cabinet having a food storage compartment with a least one single access front opening bounded by front perimeter, top, bottom and side walls. The refrigerator includes a pair of doors mounted to the refrigerator cabinet to move between an open position permitting access to the food compartment through the single access front opening and a closed position to close the single front access opening of the refrigerator cabinet where the doors sealingly contact each other, one of the side walls, and a portion of the perimeter top and bottom walls. The refrigerator includes cooperative door seal means each affixed along one of the doors adjacent an outside door edge of the one door to extend the length of the one door between the top and bottom walls of the refrigerator cabinet. At least one of the cooperative door seal means is adapted to move relative to the other cooperative door seal means for engagement therewith to effect a seal between the doors when the doors are in the closed positions. The refrigerator further comprises a door closure stop means affixed to each one of the doors adjacent to the outside door edge and the cooperative door seal means. The door closure stop means projects a predetermined distance forward of each one of the doors towards the refrigerator cabinet for force engaging and supporting relation with the top and bottom walls of the refrigerator cabinet to positively locate the outside door edge a constant distance from the refrigerator cabinet and maintain seal alignment integrity between the cooperative seal means along the length of the doors when the doors are in the closed position.

It should be understood that by force engaging and supporting relation it is meant that the closure stop means either directly abuts against or is in indirect contacting relation with the top or bottom wall of the refrigerator compartment.

In accordance with an embodiment of the present invention the door closure stop means forms an integral part of the retainer. The door stop means includes an elongate flange which co-extends with the cooperative door seal means along the length of the doors so as to reinforce the door adjacent to the outer door edge and distribute door closing local forces adjacent the top and bottom walls transferred to the stop means along the elongate flange. The elongate flange includes upper and lower end portions that respectively at least indirectly engage the top and bottom walls of the refrigerator cabinet when the door is in the closed position. Alternatively, the door closure stop means may comprise load bearing posts extending or projecting forward of the side-by-side doors in load bearing engagement with the top and bottom walls of the refrigerator cabinet and may be formed separately of the retainer.

In a preferred embodiment, the elongate flange has a bent leg which is angled forming an L-shape in cross section. Door seals means or magnets are supported and positively located within the gasket in front of the leading leg of the L-shaped flange to support the gasket sealing surface adjacent the magnets against door closing forces. The door seals means has a leading surface that overlaps the forward leg of the L-shaped flange. The leg of the L-shaped flange provides a substantially flat surface whose upper and lower end portions indirectly engage the top and bottom walls of the refrigerator cabinet through the leading surface of the door seal means which is sandwiched between the L-shaped flange and walls of the refrigerator.

In a preferred embodiment of the present invention there is provided a cooperative door seal means comprising a moveable gasket attached to a retainer secured to an edge of the door. The retainer holds and secures relative thereto the outer door casing wall and the inner door plastic door liner. The retainer includes an L-shaped door closure stop means. The moveable gasket comprises a flexible web having an air bellows portion and a magnetic chamber portion adapted to move relative to the edge of the door. The poles of the magnets of each of the door closure seal means are orientated in such a fashion as to provide for initial repulsion of the magnets when the doors are in the partially opened position and attraction of the magnets when the doors are in the closed position.

In accordance with another aspect of the present invention there is provided a refrigerator door gasket assembly mounted to juxtapositioned facing sides of side-by-side refrigerator doors. The refrigerator doors extend between side walls, a top wall and a bottom wall of a refrigerator cabinet across a single access opening for the cabinet. The gasket assembly comprises a retainer and a gasket co-extending along the length of each one of the doors between the top and bottom walls of the refrigerator cabinet where at least one of the gaskets is movable relative to the other gasket seal to provide a thermal seal between the juxtapositioned facing sides of the doors. The gasket seal comprises a base portion mounted to the retainer. The gasket seal includes a first sealing surface portion attached to the base portion adapted to sealingly engage a corresponding first sealing surface portion of the gasket mounted to the other door. The retainer is secured to the facing side of the one refrigerator door. The retainer includes gasket retention means for seating the gasket seal relative thereto. The retainer includes door closure stop means projecting a predetermined distance forward of the one door towards the refrigerator cabinet for force engaging and supporting relation with the top and bottom walls of the refrigerator cabinet to positively locate the first sealing surface portion of the first sealing surface portion of the gasket seal a predetermined distance from the refrigerator cabinet and to maintain seal alignment integrity between the gasket seals extending along the length of the doors.

BRIEF DESCRIPTION OF THE DRAWINGS

For a better understanding of the nature and objects of the present invention reference may be had to the following detailed description when taken in conjunction with the accompanying diagrammatic drawings wherein.

DETAILED DESCRIPTION OF EMBODIMENTS

Figure 1:
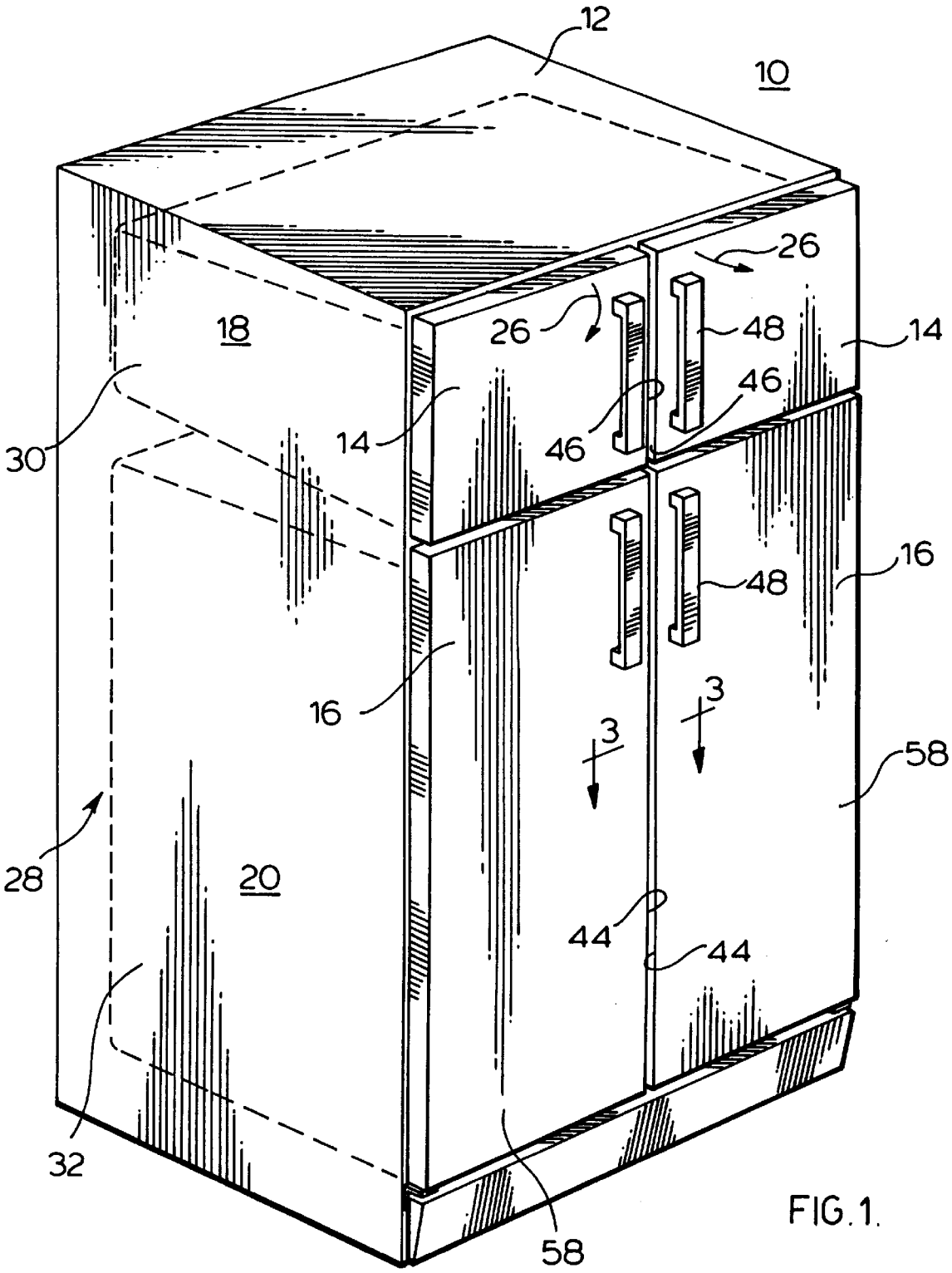
FIG. 1 is a perspective view of a refrigerator having side-by-side, or "French" doors in accordance with the present invention.
Figure 2:
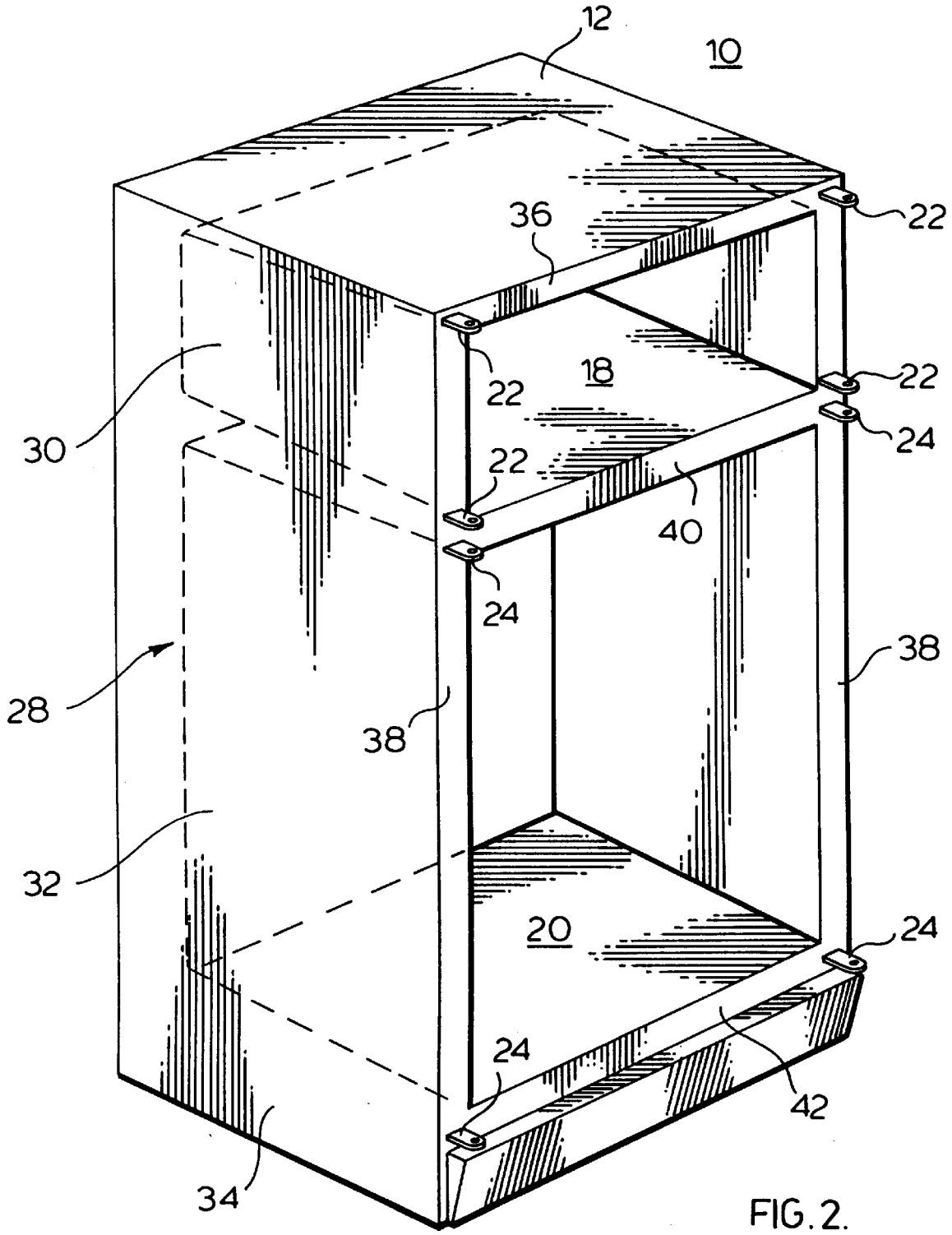
FIG. 2 is a perspective view of the refrigerator cabinet of the present invention with the side-by-side doors removed.

Referring to FIGS. 1 and 2 there is shown a refrigerator 10 having a cabinet 12 with two pairs of French doors 14 and 16 positioned in a side-by-side closed position. The upper pair of French doors 14 are adapted to close the freezer food compartment 18 and the lower pair of French doors 16 are provided to close the fresh food compartment 20. The upper pair of doors 14 are connected to the refrigerator cabinet by hinges 22 and the lower pair of French doors 16 are connected to the refrigerator cabinet through lower hinges 24. The hinge structure may be any suitable hinge provided in the art and forms no part of the present invention. The doors 14 and 16 pivot about the hinges from the closed position shown in FIG. 1 to an open position by moving in the general direction shown by arrows 26.

The construction of the refrigerator cabinet 12 shown in FIG. 2 comprises inserting a plastic bubble liner 28 having an upper bubble 30 and a lower bubble 32, into an assembled refrigerator casing 34. Refrigerator casing 34 is typically formed from sheet metal and may be provided with dimples on the side and top walls to provide a textured effect. The refrigerator casing 34 is shown in the drawings to have front perimeter walls which comprise top wall 36, side walls 38, mullion wall 40 and bottom wall 42. It should be understood that the mullion wall 40 forms what is referred to throughout the specification and claims as the top wall of the food compartment comprising the fresh food compartment 20. Alternatively, the mullion 40 also forms the bottom wall for the food compartment 18, typically the freezer compartment. It should be understood that each of these peripheral walls 36, 38, 40, and 42 may be formed from either the sheet metal material of the casing 34 or alternatively a leading edge plastic retainer profile which acts to hold the bubble liner 28 within the metal casing 34. Once assembled, the empty spaces between the liner 28 and casing 34 are filled with foam.

Figure 3:
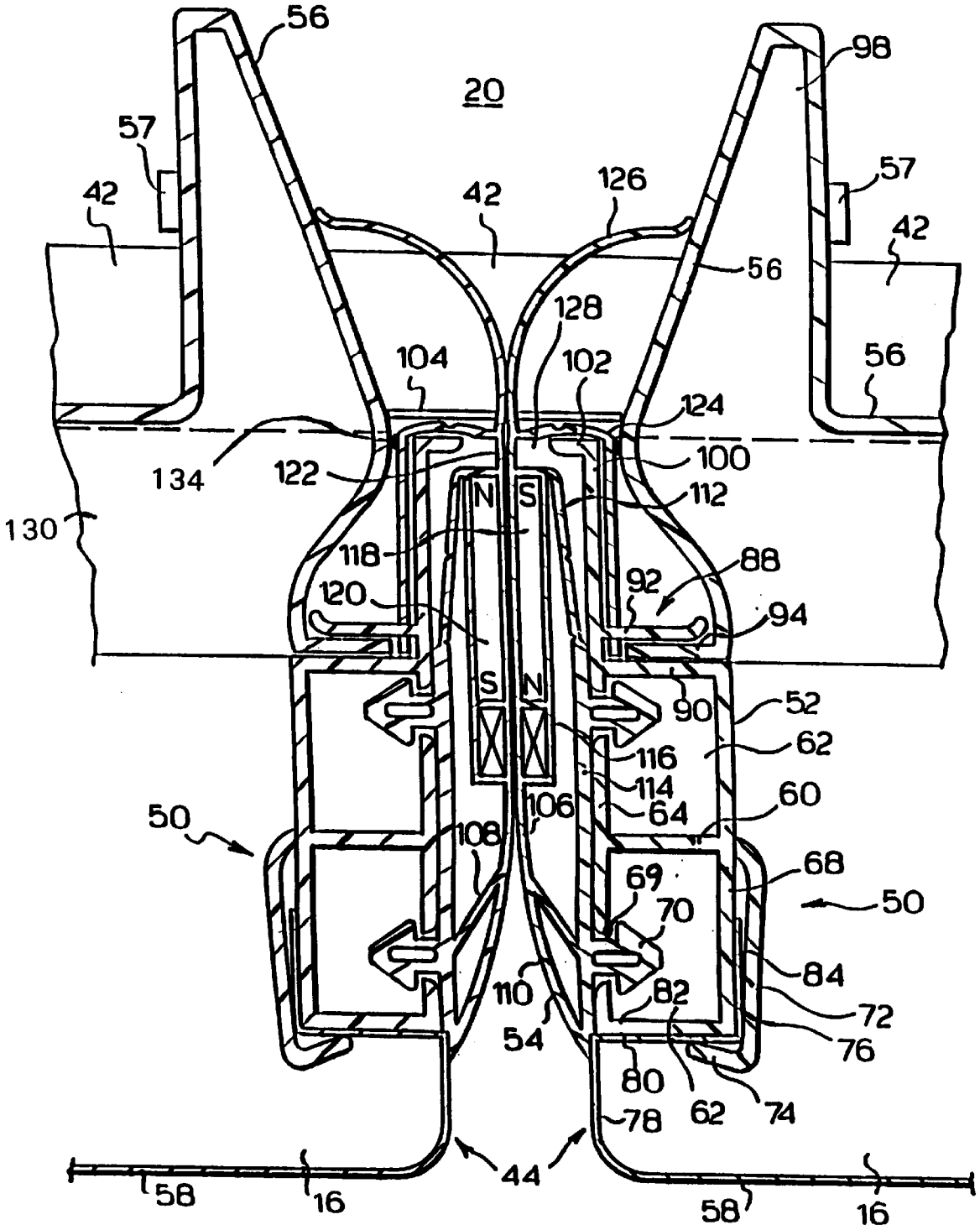
FIG. 3 is a sectional view of the side-by-side refrigerator doors taken along section lines 3—3 of FIG. 1 which shows a first preferred embodiment of the seal assembly of the present invention.
Figure 4:
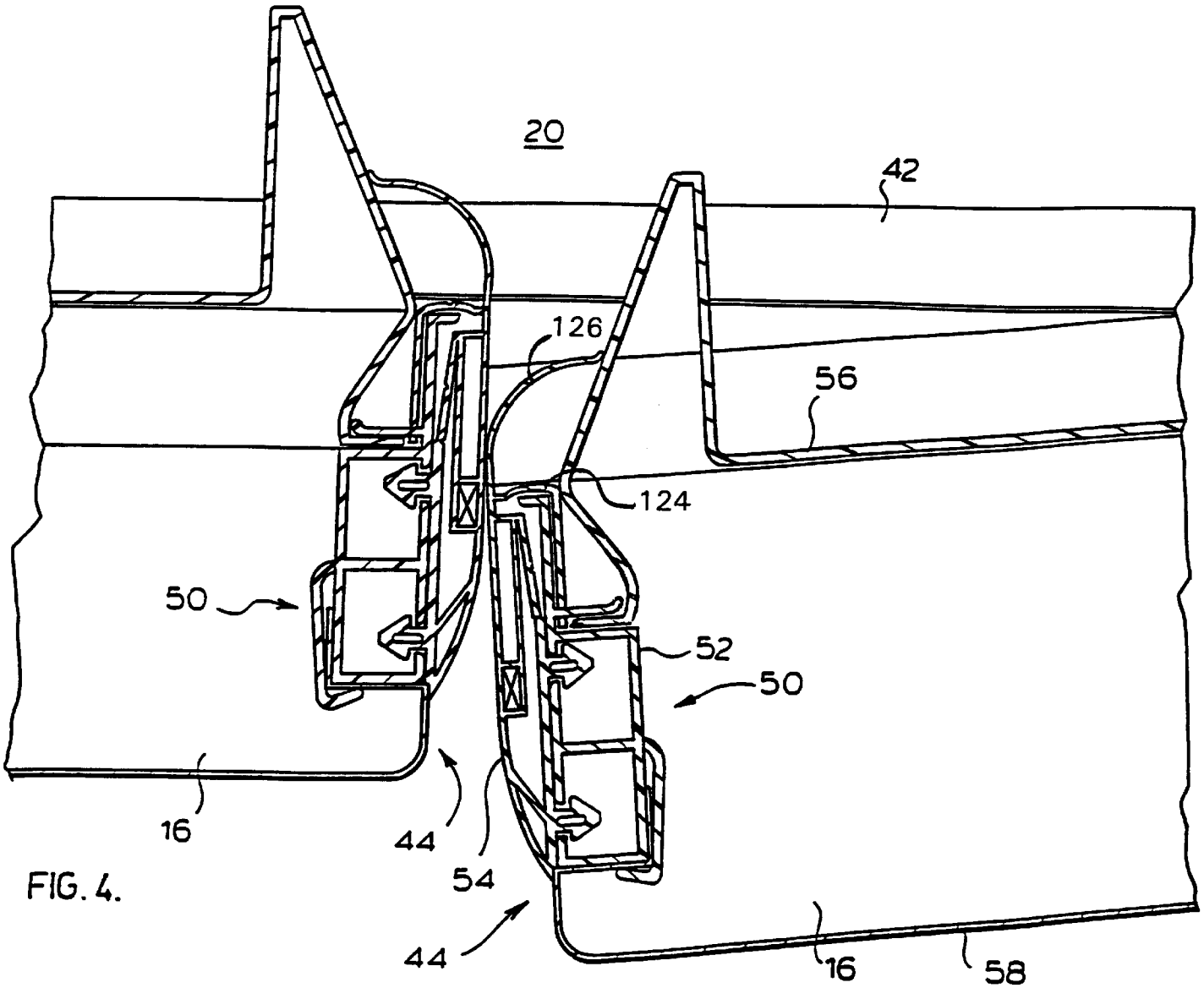
FIG. 4 is a view similar to FIG. 3 showing one of the doors partially open.

Referring FIGS. 3 and 4, the construction of the refrigerator door gasket assembly of the present invention for the French doors is described. In particular, the gasket assembly between the outside door edges 44 of the doors 16 are described. It should be understood that the door gasket assembly for the upper pair of French doors 14 provided along their juxtaposition facing outer edges 46 are similar to that described for the lower doors 16. The purpose of the gasket assembly 50 is to provide an airtight thermal barrier to prevent heat loss from the food compartment 20 between the lower doors 16 and to provide an airtight thermal barrier from the freezer compartment 18 between the upper French doors 14. These gaskets together with other magnetic sealing closures to be described later maintain the refrigerator doors 16 in the closed position shown in FIG. 1. To effect opening of the doors 16, a user must apply force on handles 48 to pull the doors 16 open relative to the cabinet 12. The effect of the partial opening of one door 16 on the French door seal arrangement in shown in FIG. 4, whereas FIG. 3 shows the seal arrangement for the doors 16 in the closed positions.

The gasket assembly 50 for each of the doors 16 are effectively mirror images of each other. The gasket assembly 50 extends along the entire length of the outer edge 44 of the doors 16 between the top wall or mullion 40 and the bottom wall 42 of the fresh food compartment 20. The gasket assembly 50 includes an elongated extrusion retainer 52 of a hardened plastic material such as a rigid PVC or ABS plastic. The gasket assembly 50 also includes an elongated extrusion gasket 54 of a pliable plastic material.

The retainer 52 interconnects the inner plastic liner 56 of the door 16 with the outer casing wall 58 of the door. Typically the outer casing wall 58 comprises a thin metal sheet of material. The inner plastic liner 56 is provided with bosses 57 spaced along the inner wall for the purposes of supporting portable bin shelves. The construction of the retainer 52 is such that when insulating foam is inserted into the open space between the outer door wall 58 and the liner 56, the retainer is held in place. It should be understood that some of the adhesion characteristics of the foam-in-place material in combination with the structure of the profile effectively secures the liner 56, retainer 52 and outer wall 58 of the door together.

The retainer 52 has a generally rectangular shaped appearance providing a rib 60 between two chambers 62. The rib 60 provides further strengthening between walls 64 and 68 of the retainer 52. The retainer wall 64 has a series of openings 69 into which darts 70 of the gasket seal 54 are inserted and held in place of the overall shape of the dart 70. The retainer 52 has a hook shape retainer clip 72 which extends from and along the rear wall 68 with a hooked tip member 74.

The outside casing 58 of the door 16 has a corner edge 78 which forms a portion of the wall facing the other opposing wall of the door 16. At this point there is a space between the two door edges 78 which allows for the opening and closing of the doors relative to each other without wiping contact.

The door edge corner 78 has an inturned L-shaped flange 76 which includes a first elongate wall 80 which abuts or lies flush against bottom wall 82 of retainer 52. The L-shaped flange 76 has a second right angled edge 84 which lies flush against wall 68 of retainer 52. The retainer clip 72 has its major wall extending over the wall 84 of the inturned flange 76 and its clip wall 74 pushing against the wall 80 of the L-shaped inturned flange. When the foam-in-place is inserted, this clips effectively sandwiches and maintains the outer casing wall 58 relative to the retainer 52.

The retainer 52 further has a U-shaped channel 88 made up of a outer wall 90 and an inturned flange 92 forming the legs of the U of the channel 88. Inserted within this channel member is an end flange 94 of the inner door liner 56. It should be understood that the door liner 56 are filled with insulation foam material which acts against the liner and forces the flange 94 into the channel 88 of the profile. The retainer 52 further includes a reinforcing edge flange 100 having an inturned edge tip 102. The distance that the flange 100 extends from the wall 90 of retainer 52 is a constant distance which ensures that the profile is maintained a constant distance from the tip of edge 102. The edge flange 100 and the tip 102 extend along the entire length of the door 14 and 16. The upper portions of the tip 102 and the lower portions of the tip 102 contact respectively the upper mullion wall 40 and the bottom front wall 42 of the refrigerator cabinet. The purpose of the tip wall 102 and the flange 100 is to limit the movement of the door 16 relative to the edge 104 of the bottom wall 42 and a corresponding edge (not shown) of the top wall 40. Additionally, the flange 100 and tip wall 102 transfer load closing forces from the cabinet contract with the door along the profile. This feature of the present invention acts to ensure that the door 16 does not bow along its length since the flange edge 100 or acts as reinforcing rib.

The gasket seal 54 is shown secured to the retainer 52 by darts 70. The gasket seal 54 has flexible webs 106, 108, 110, and a web 112 all attached to a base portion 114. The sealing gasket 54 has two chambers 116 and 118. Chamber 118 houses a magnet 120, and the rear chamber 116 provides an air pocket thermal seal. The gasket means 54 has located forward of the chamber 118 a trunk 122 which has two branches 124 and 126. Branch 126 curls on a radius to allow it to provide for additional sealing into the compartment with its mirror branch 126 on the other seal. The branch 124 or leading surface 124, curves around the edge tip 102 and along the side of the edge flange 100 of the retainer 52 as a tail edge and is secured in place by gasket 130 (see FIG. 6). The tip 102 contacts the branch 124 of the gasket to push branch 124 into engagement with the edge 104 of the walls 36, 40 and 42. In this respect, the profile edge tip 102 is said to be in indirect contact with the walls 36, 40 and 42 of the refrigerator cabinet.

The magnets 118 and 120 have opposite North and South poles so that when the magnets attract each other when the doors are closed. The magnets pass by each other as the doors open thereby aligning like poles that repel the gaskets apart to reduce the wiping effect of the gaskets during opening and closing.

The advantage associated with the seal arrangement of the present invention is found in the constant distance that the protruding edge 100 and the tip 102 move forward of the door and contact the top and bottom walls of the refrigerator food compartment. This ensures that the mutually sealing portions of the gasket 54 located rearwardly of the protruding tips 104 within the L-shape portion of the retainer 52 are maintained in an elongated alignment maintaining the seal integrity. Further, the retainer tip 102 prevents the gasket associated with this portion of the door near the top and bottom walls from being stressed unduly by the closing forces associated with the door hinges when these gaskets would otherwise come into contact with the top and bottom walls of the door.

Figure 5:
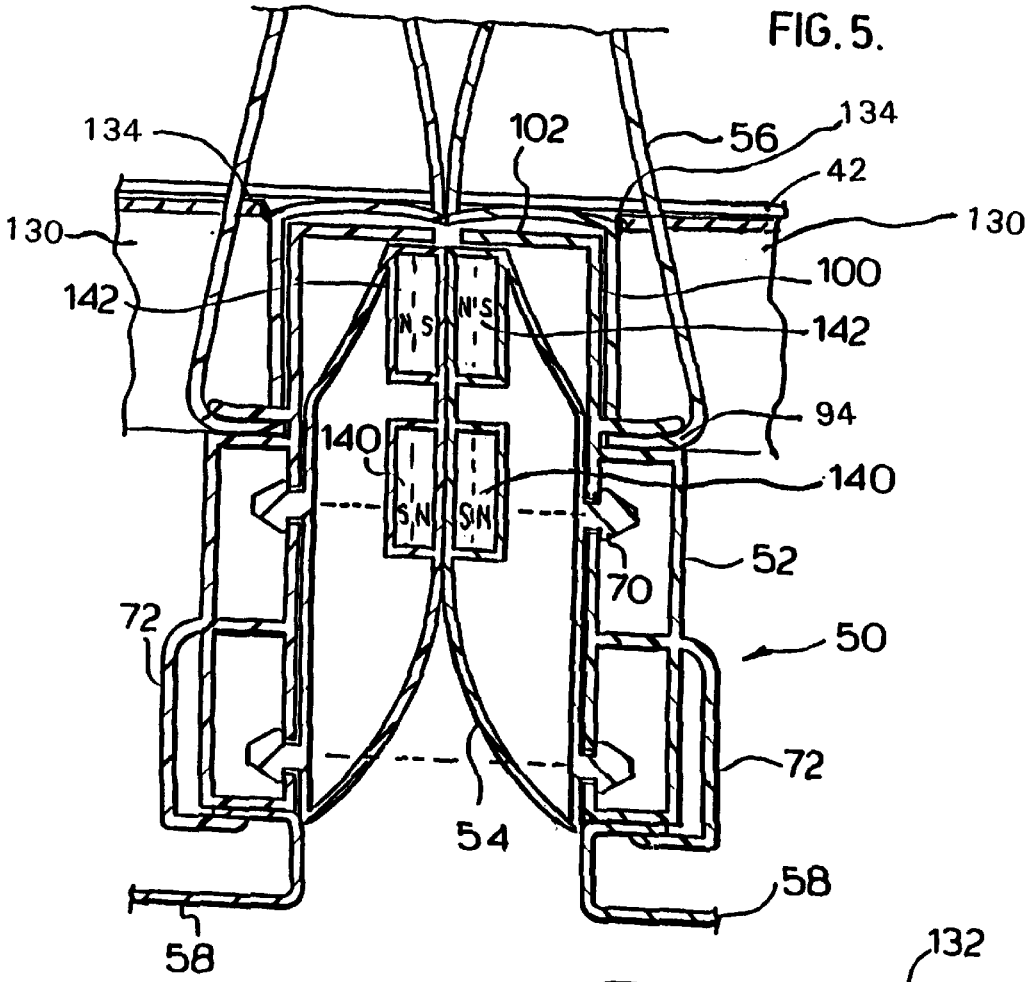
FIG. 5 is a view similar to FIG. 3 but shows an alternative embodiment for the seal assembly of the present invention.
Figure 6:
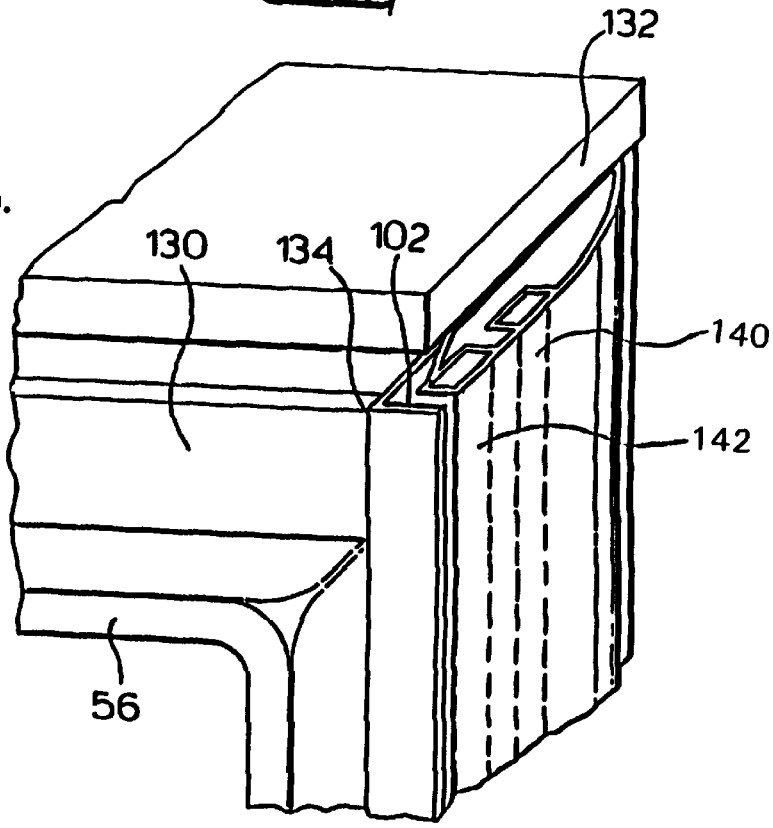
FIG. 6 is a partial isometric view of a top edge corner of the side-by-side door of the present invention showing the seal assembly of FIG. 5; and, FIG. 7 is a view similar to FIG. 3 and showing yet another embodiment for the door gasket seal and door liner.

Referring to FIGS. 5 and 6 there is shown an alternative embodiment for the present invention. In this particular embodiment, the leading tip edge portion 102 of the retainer 52 is more elongate. Also, two sets of magnets 140,142 having North and South poles are provided to effect a stronger seal.

Referring to FIG. 6, there is shown a perspective view of a top edge corner of the door of the present invention showing the seal gasket embodiment of FIG. 5. It should be noted that along the top portion of the seal facing the top wall of the refrigerator cabinet is an additional seal 130. Seal 130 and the leading edge portion or flange portion 102 of the retainer extend forward of the door casing top wall 132. Branches 124 and 126 of gasket 54 are not shown. Gasket branch 124 would normally pass over retainer tip 102 and be butt welded at 134 to the edge of gasket 130. Further it can be seen that the magnets 140, 142 extend the entire length of the door gasket seal. Referring again to the seal magnet gasket 130, it should be understood that this is a typical type of gasket which may follow along the designs of the gasket shown in U.S. Pat. No. 4,469,383 issued Sep. 4, 1984 to Losert. Further, a similar seal exists on the door contacting a portion of the bottom wall and one side wall of the refrigerator cabinet.

The curing of the gasket 132 to the edge portion 102 above the door liner 56 can be done by forming a butt weld at 134. Simply having a hot edge surface of the profile in contact with the gasket so that the gaskets will, in effect, weld together through the heat or by using a special solvent or glue.

The purpose of the butt weld at 134 is to allow adhesion of the gasket 132 to the forward protruding edge 102 of the retainer 52. The butt welding is done by simply heating the two surfaces and having them adhere to each other and weld or weld by using special solvent or glue.

Alternatively, the butt weld at 134 can be made to branch 124 of gasket 54 which branch 124 is shown to surround retainer tip 102 in FIGS. 3 and 5 with branch 124 having a butt weld at 134 to gasket 130.

Figure 7:
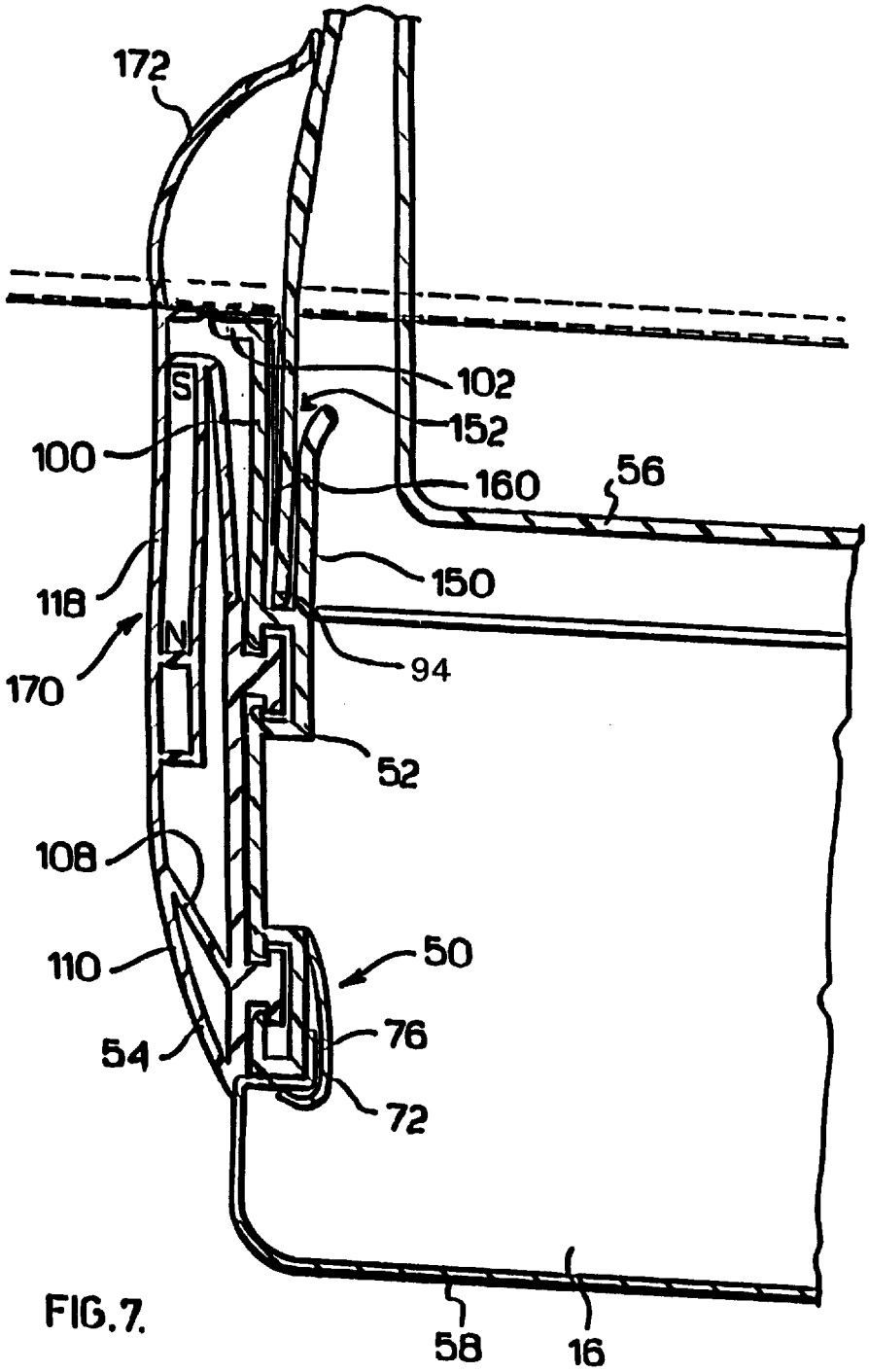

Referring to FIG. 7, there is shown another embodiment of the gasket assembly of the present invention. In this embodiment, there is one significant change from FIG. 3. The retainer 52 is relatively flat compared to the retainer of FIG. 3 and has an arm 150 extending adjacent and parallel to flange 100. Tail 160 of gasket 54 fits into slot 152 together with door liner flange 94. Flattening of the retainer 52 increases the insulation at the door edge.

What is claimed is:

1. A refrigerator comprising:

a refrigerator cabinet having at least one food storage compartment with a single access front opening bounded by front perimeter top, bottom and side walls;

a pair of doors mounted to said refrigerator cabinet to move between an open position permitting access to said food compartment through said single access front opening and a closed position to close said single front access opening of the refrigerator cabinet where the doors each sealingly contact each other, one of the side walls, and a portion of the perimeter top and bottom walls;

co-operative door seal means each affixed along one of said doors adjacent an outside door edge of the one door to extend the length of said one door between the top and bottom walls of said refrigerator cabinet, at least one of said co-operative door seal means being adapted to move relative to the other co-operative door seal means for engagement therewith to effect a seal between said doors when said doors are in the closed position;

door closure stop means affixed to each one of said doors adjacent said outside door edge and said co-operative door seal means, said door closure stop means projecting a predetermined distance forward of each one of said doors towards said refrigerator cabinet for force engaging and supporting relation with the top and bottom walls of said refrigerator cabinet to positively locate the outside door edge a constant distance from the refrigerator cabinet so as to maintain seal alignment integrity between the co-operative door seal means along the length of the doors when said doors are in their closed position; and, the co-operative door seal means including mutually abutting sealing surfaces extending between said outside door edges and along the length of said doors, said mutually sealing surfaces projecting forward of said door edges a distance exceeding the predetermined distance the door stop closure means projects toward said refrigerator cabinet.

2. A refrigerator comprising:

a refrigerator cabinet having at least one food storage compartment with a single access front opening bounded by front perimeter top, bottom and side walls;

a pair of doors mounted to said refrigerator cabinet to move between an open position permitting access to said food compartment through said single access front opening and a closed position to close said single front access opening of the refrigerator cabinet where the doors each sealingly contact each other, one of the side walls, and a portion of the perimeter top and bottom walls;

co-operative door seal means each affixed along one of said doors adjacent an outside door edge of the one door to extend the length of said one door between the top and bottom walls of said refrigerator cabinet, at least one of said co-operative door seal means being adapted to move relative to the other co-operative door seal means for engagement therewith to effect a seal between said doors when said doors are in the closed position; and, door closure stop means affixed to each one of said doors adjacent said outside door edge and said co-operative door seal means, said door closure stop means projecting a predetermined distance forward of each one of said doors towards said refrigerator cabinet for force engaging and supporting relation with the top and bottom walls of said refrigerator cabinet to positively locate the outside door edge a constant distance from the refrigerator cabinet so as to maintain seal alignment integrity between the co-operative door seal means along the length of the doors when said doors are in their closed position, and said door closure stop means including an elongate flange co-extending with the co-operative door seal means along the length of the door, said elongate flange including upper and lower end portions that respectively at least indirectly engage the top and bottom walls of the refrigerator cabinet when the door is in its closed position, the elongate flange of the door closure stop means having a bent knee forming an L-shape in cross-section, the door seal means including an elongate magnet extending the length of the door, said magnet being supported in the gasket within the L-shaped flange, said door seal means having first sealing surface portions extending substantially from between said outside door edges forward to the bent knee of the door closure means, and said door seal means including a leading tail extending from the first sealing surface portion around the L-shaped flange and into the food compartment, the leg of the L-shaped bent knee elongate flange providing a substantially flat supporting surface whose upper and lower end portions indirectly engage the top and bottom walls of the refrigerator cabinet.

3. A refrigerator door gasket assembly mounted to juxtapositioned facing sides of side-by-side refrigerator doors that extend between side walls, a top wall and a bottom wall of a refrigerator cabinet across a single access opening for the refrigerator cabinet, said gasket assembly comprising:

a retainer and a gasket co-extending along the length of each one of the doors between the top and bottom walls of the refrigerator cabinet where at least one of the gaskets is movable relative to the other gasket to provide a thermal seal between the juxtapositioned facing sides of said doors;

said gasket seal comprising a base portion mounted to said retainer, and said gasket including a first sealing surface portion attached to said base portion adapted to sealingly engage a corresponding first sealing surface portion of the gasket mounted to the other door;

said retainer being secured to the facing side of said one refrigerator door, and said retainer including gasket retention means for seating said gasket relative thereto, said retainer including door closure stop means projecting a predetermined distance forward of said one door towards said refrigerator cabinet for force engaging and supporting relation with the top and bottom walls of said refrigerator cabinet to positively locate the first sealing surface portion said gasket seal a predetermined distance from the refrigerator cabinet to maintain seal alignment integrity between the gasket seals extending along the length of the doors; and, said door closure stop means including an elongate flange co-extending with the gasket seal along the length of the door, said elongate flange including upper and lower end portions that respectively at least indirectly engage the top and bottom walls of the refrigerator cabinet; said elongate flange being angled to have an L-shape in cross-section, the gasket seal having an inside surface opposite to the first sealing surface portion for carrying an elongate magnet, said first surface sealing portion of said gasket extending substantially from between the juxtapositioned facing sides of the refrigerator doors forward to the angle of the flange, and the L-shaped flange providing a substantially flat supporting surface having upper and lower portions that indirectly engage the top and bottom walls of the refrigerator cabinet.

4. The refrigerator door gasket assembly of claim 3 wherein the gasket seal includes a leading surface that overlaps the angled flange and is sandwiched between the angled flange and the top and bottom walls of the refrigerator cabinet when doors are closed.

* * * * *